United States Patent [19]

Grabel et al.

[11] 4,257,604

[45] Mar. 24, 1981

[54] IN-LINE DROP TARGETS

[75] Inventors: Irwin J. Grabel, Elmwood Park; Glenn R. Andersen, Chicago, both of Ill.

[73] Assignee: Bally Manufacturing Corporation, Chicago, Ill.

[21] Appl. No.: 45,139

[22] Filed: Jun. 4, 1979

[51] Int. Cl.[3] ..... A63B 71/00

[52] U.S. Cl. ..... 273/127 R

[58] Field of Search ..... 273/129 R, 121 A, 122 A, 273/123 A, 124 A, 125 A, 41; 200/61.11

[56] References Cited

U.S. PATENT DOCUMENTS

| | | | |
|---|---|---|---|
| 1,111,592 | 9/1911 | Keenan | 273/41 |
| 1,534,522 | 4/1925 | Holliday | 273/127 R |
| 2,192,283 | 3/1940 | Archibald | 273/127 R |
| 2,289,690 | 7/1942 | Bakalyar | 273/127 R |
| 2,317,506 | 4/1943 | Williams et al. | 273/123 A |
| 4,037,842 | 7/1977 | Breslow | 273/127 R |

*Primary Examiner*—Richard C. Pinkham
*Assistant Examiner*—T. Brown
*Attorney, Agent, or Firm*—Fitch, Even, Tabin, Flannery & Welsh

[57] ABSTRACT

A play feature for a pinball machine is described comprising a plurality of drop targets that are preferably located in-line along a confined lane of a pinball playfield, each of the drop targets extending through an opening in the playfield and being movable between an up and a down position. The play feature further comprises means for releasably maintaining each of the drop targets in the up position until struck by a ball propelled up the lane, resetting means for simultaneously raising the drop targets from the down position to the up position, and driving means for driving the resetting means in response to an electric signal being applied thereto.

23 Claims, 6 Drawing Figures

IN-LINE DROP TARGETS

This invention relates to pinball games and, more particularly, to a play feature for a pinball game.

The design of the playfield of a pinball machine is critical to the commercial success of the pinball machine. To this effect an appropriate combination of play features are desirable to produce a game with an appealing play. Generally, a pinball machine having a challenging but controlled game format, with other operating features such as multiple player play, compound or bonus scoring systems, and bonus ball replays, will be accepted and will be in great demand in the marketplace. However, because experienced players become rather selective in the pinball game apparatus on which they play, the owners and therefore the suppliers of such apparatus are constantly looking for new game formats and new play features to add to the pinball game apparatus to make the play more appealing. For these reasons, new play features are continually being built into pinball game apparatus which hopefully will appeal to both players and owners.

However, even though any single play feature might appeal to the player, it must be of reliable and durable construction and operation, and it must be capable of economical incorporation in the game apparatus to appeal to the manufacturer and owner. In the past play features have included any number of apparatus, such as roll over buttons, spinner lanes, flipper bumpers and drop targets. Drop targets have been used in the prior art, but in the past the drop targets have been either used as single targets or placed side to side. Accordingly, it is an object of the present invention to provide a novel play feature for a pinball machine.

More particularly stated, it is an object of the present invention to provide a novel play feature for a pinball machine which comprises a plurality of drop targets located in-line within a confined lane on the playfield of the pinball machine.

Another object of the invention is to provide a novel play feature of the type described which prevents a ball which is propelled up the lane containing the play feature and which strikes a drop target, from continuing down the lane and striking another drop target.

Other objects of the invention in addition to those set forth above will become apparent to those skilled in the art from the following description taken in connection with the accompanying drawings wherein.

Figure 2:
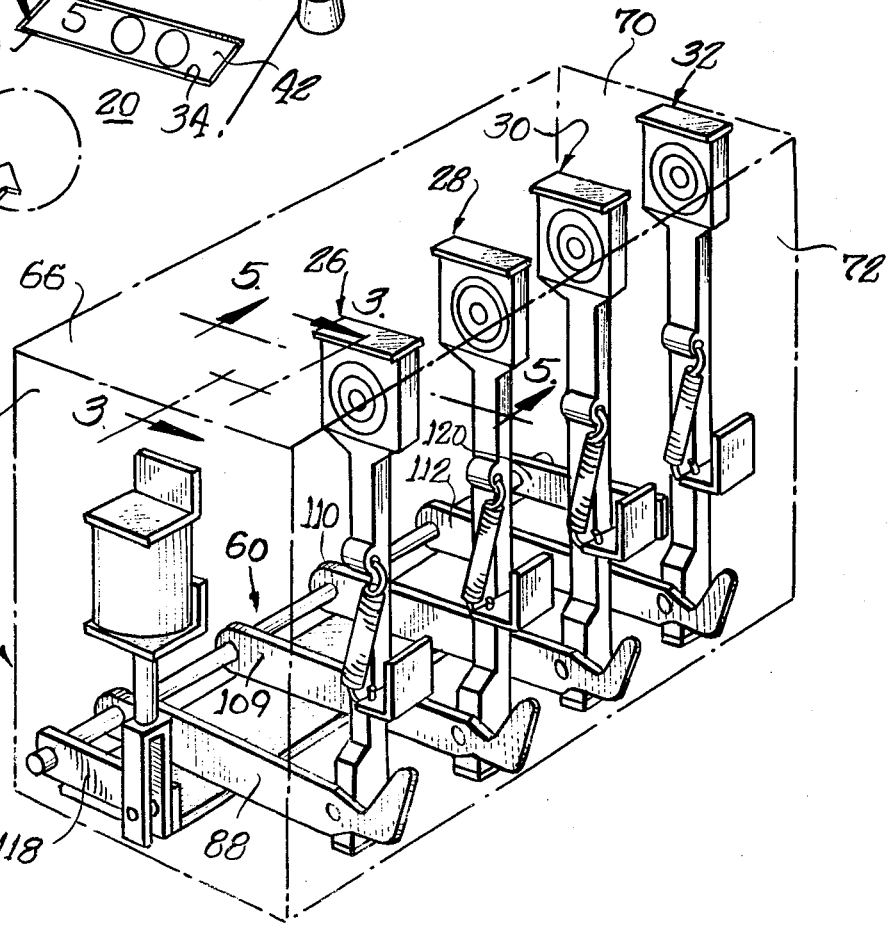
FIG. 2 is a perspective view of the device of the present invention.
Figure 3:
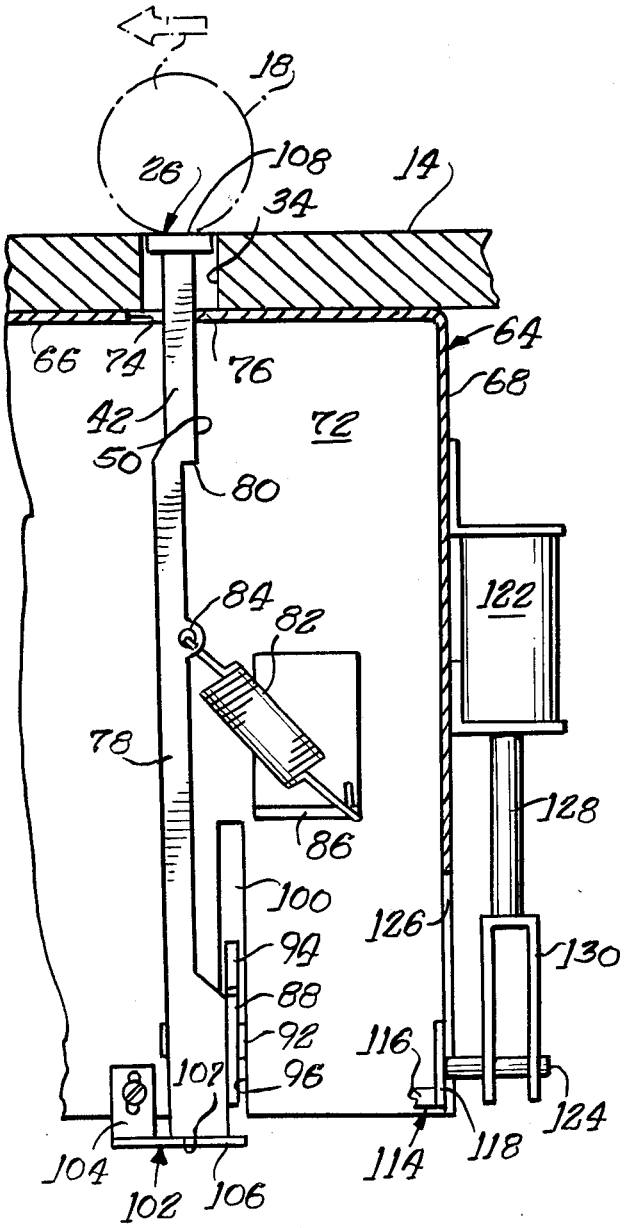
Figure 4:
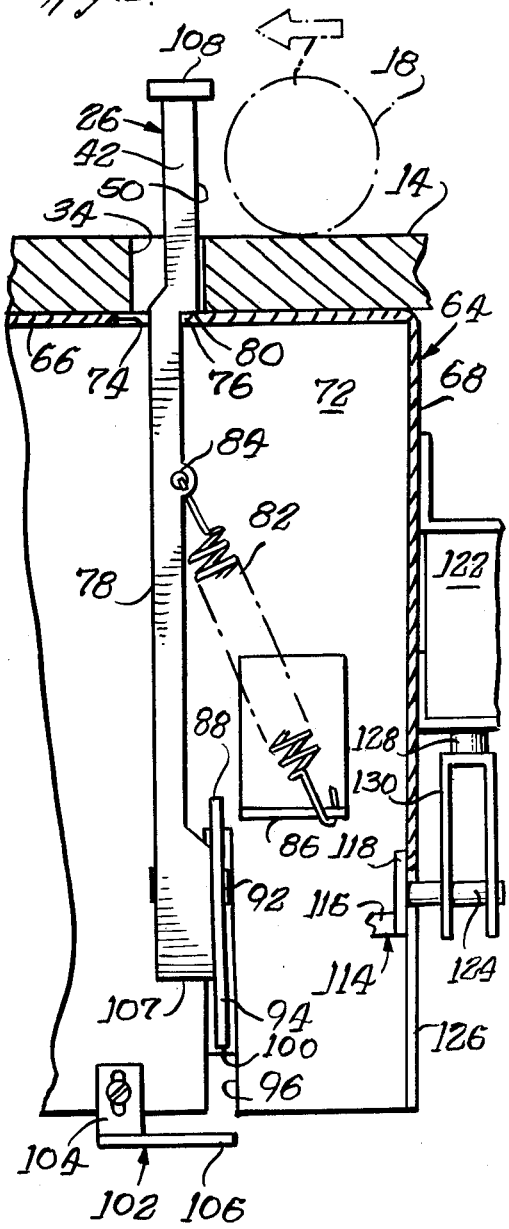
Figure 5:
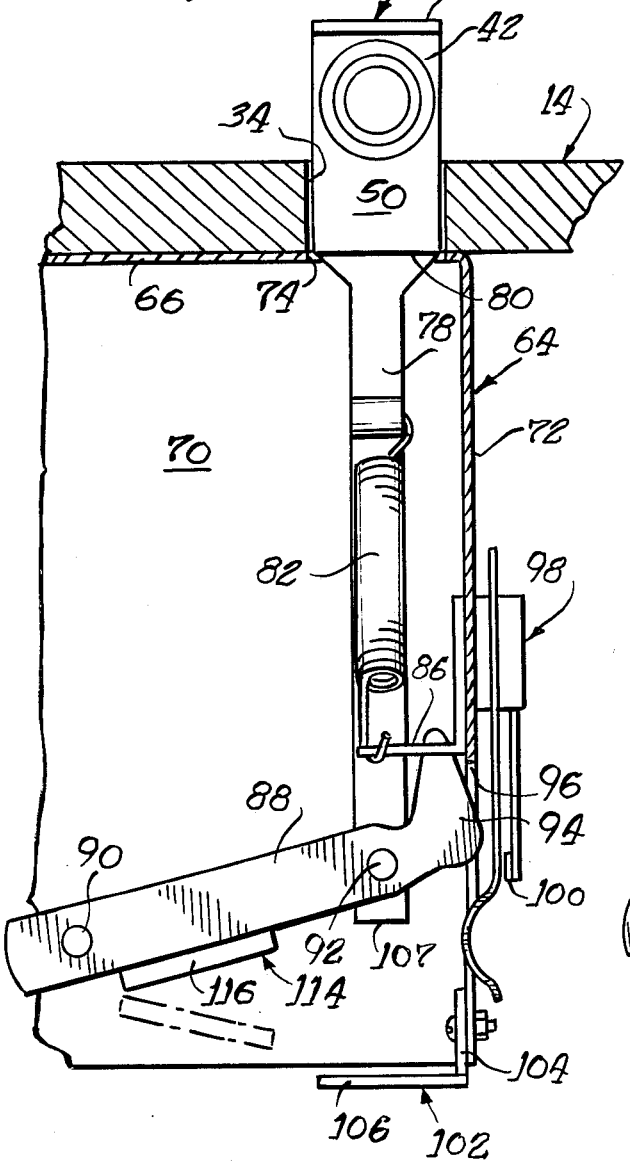
Figure 6:
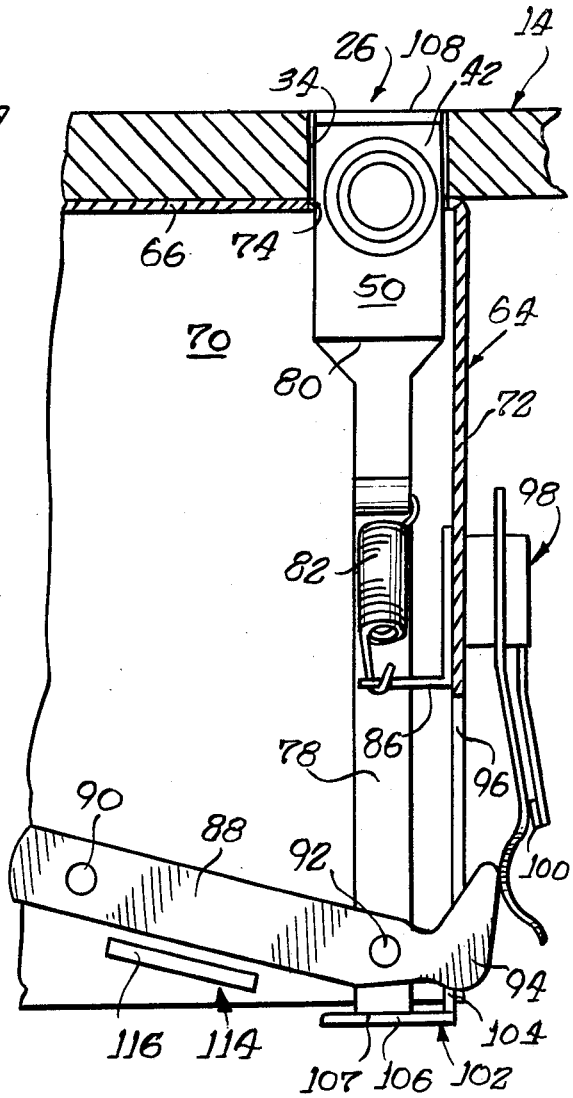

FIGS. 3 and 4 are sectional views taken generally along the line 3—3 in FIG. 2 showing a drop target in the down and up positions, respectively; and FIGS. 5 and 6 are sectional views taken generally along the line 5—5 in FIG. 2 showing a drop target in the up and down positions, respectively.

Broadly stated, the device of the present invention comprises a plurality of drop targets that are preferably located in-line along a confined lane of a pinball playfield.

Figure 1:
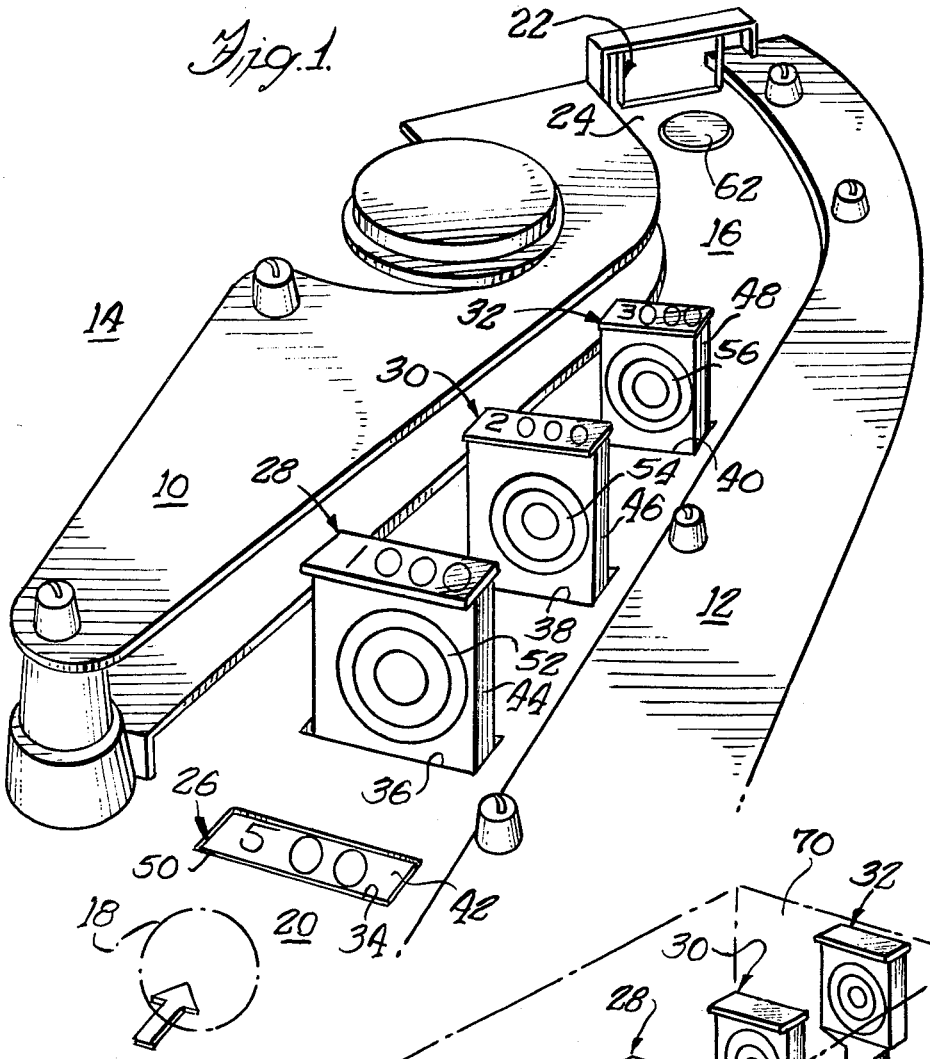
FIG. 1 is a perspective view, showing a portion of the top of a playfield of a pinball machine containing the device of the present invention.

Referring more particularly to the drawings, FIG. 1 shows a portion of a playfield 14 of a pinball machine which contains the device of the present invention. Guides 10 and 12 are attached to the surface of the playfield 14 thereby defining a confined lane 16 within which a ball 18 shown in phantom can roll. The ball 18 enters the lane 16 from an entrance 20. A one-way overhead bracket 22 is located at an exit 24 which is located at the top of the lane 16. The bracket 22 is provided to prevent the ball 18 from entering the lane 16 from beyond the exit 24.

The device of the present invention includes a number of drop targets, indicated generally at 26, 28, 30 and 32, preferably evenly spaced and located in-line along the lane 16. These drop targets are located in respective slots 34, 36, 38 and 40 in the playfield 14 and can extend perpendicularly relative to the general plane of the playfield 14 through the slots. The drop targets 26, 28, 30 and 32 have respective and preferably identical rectangularly shaped target bodies 42, 44, 46 and 48. The target bodies 42, 44, 46 and 48 have target faces 50, 52, 54 and 56 respectively, which are also generally perpendicular to the playfield 14.

Each of the drop targets has an up position and a down position, and in FIG. 1, the drop target 26 is shown to be in the down position and the drop targets 28, 30 and 32 are shown to be in their up position. In the up position, each target body extends above the playfield 14 and blocks the passage of the ball 18 rolling along the lane 16 from the entrance 20. In the down position, each target body is below the playfield 14 with a top surface flush with the top surface of the playfield 14. When the target is in the down position, the ball 18 can easily roll over the drop target in either direction along the lane 16.

When the ball 18 rolls up the lane and strikes the target face of a drop target in the up position, the ball 18 rebounds back down the lane and the drop target slides down the slot to its down position, provided the ball had sufficient speed and momentum to actuate the drop target.

The play feature described above preferably operates as follows with a pinball machine. At the start of play of each ball, all four targets are reset in the up position by a resetting means 60 that is located under the playfield 14. Points are scored by the player successively propelling the ball 18 into the lane and successively knocking down all four drop targets. Each time a ball enters the lane and strikes a drop target in the up position, that drop target falls to the down position and the ball rebounds back down the lane and back into play. Preferably, each of the drop targets progressively has a higher score. For example, in the illustrated embodiment, the drop target 26 has a value of 500 points, the drop target 28 a value of 1,000 points, the drop target 30 a value of 2,000 points and the drop target 32 a value of 3,000 points. When all four drop targets have been knocked down to the down position, the next ball that enters the lane rolls over the drop targets, over a roll-over button 62, out of the lane 16 through the exit 24, and thereby back into play. When the ball 18 rolls over the roll-over button 62 which is located near the exit 24, the resetting means 60 are actuated thereby resetting all of the drop-targets to the up position. The roll-over button 62 can also be connected to means for registering a special score on the pinball machine. Therefore, the object of playing the play feature is to propel the ball 18 into the lane 16 as many times as possible during the play of a single ball. It is noted that the roll-over button 62 can be replaced with a kickout hole or other features which perform the same function as the roll-over button 62.

Referring to FIG. 2, there is shown a perspective view of the drop targets 26, 28, 30 and 32 with the attached resetting means 60 encased in a housing 64 (shown in phantom). The housing 64 comprises a top plate 66, a front plate 68, a back plate 70 and a side plate 72. The top plate 66 is secured flush to the bottom of the playfield 14 directly under the lane 16.

The construction of all of the drop targets and their associated reset mechanisms are identical. Therefore, only the construction of the drop target 26 will be described in detail. Referring to FIGS. 3 and 4, a slot 74 in the top plate 66 is located under the slot 34 in the playfield 14. The slots are offset relative to one another, leaving a lip 76 defined by the top plate 66 positioned along one side of the slot 34.

The drop target 26 comprises the target body 42 integrally attached to the top of a elongated handle-like support 78. The support 78 is connected near the back of the target body 42 away from the target face 50 thereby defining a flat surface 80 at the bottom of the target body 42 that is substantially traverse to the lengthwise direction of the support 78. The target body 42 extends through the slots 34 and 74.

A spring 82 has one end attached to the front of the support 78 through a hole 84, and its other end attached to a bracket 86 that is secured to the inside of the side plate 72. The bracket 86 is located in front of the support 78 and below the hole 84. Referring to FIG. 3, when the drop target 26 is in the down position as shown, the spring 82 is oriented at about a 45° angle below the playfield 14. Referring to FIG. 4, when the drop target 26 is in the up position as shown, the spring 82 is extended and in tension. The support 78 is forward biased in this manner so that when the drop target 26 is reset to the up position, the surface 80 will engage the lip 76 and remain so engaged until hit by a ball propelled up the lane. When the drop target 26 is reset to the up position, as the surface 80 reaches the top surface of the lip 76, the spring 82 pulls the drop target 26 forward whereby the surface 80 slides along the top surface of the lip 76 to the front of the slot 74. Referring to FIG. 4 when the drop target 26 is in the up position there is a slight gap between the target face 50 and the surface defining the front of the slot 34 to minimize wear on the target face 50.

It is noted that this design as described above ensures that a ball which has struck the target face 50 and thereby caused the drop target 26 to drop from the up position to the down position will rebound off the drop target 26 rather than continue up the lane 16 and possibly strike another drop target. As a ball strikes the drop target 26 it slides backward and is forced up against the surface defining the back of the slot 34 before being pulled down by the spring 82. As the drop target 26 begins to fall the back surface of the drop target 26 is restrained by and slides along the surface defining the back of the slot 34, thereby insuring that the ball will rebound off of the target 26 rather than continue on down the lane 16 and possibly strike another drop target.

In accordance with another aspect of the present invention, and referring particularly to FIGS. 5 and 6, the mechanism for activating the electrical switching for advancing the player's score when the drop target has been struck by the ball will now be described. A link 88 has one end portion pivotally mounted to a shaft 90 which is securely mounted to the front and back plates 68 and 70 (see FIG. 2). The other end of the link 88 is pivotally mounted near the bottom of the support 78 by a pin 92, perpendicular to the target face 50. Therefore, when the drop target 26 moves between the up and down positions, the link 88 pivots about the shaft 90 as is best shown in FIGS. 5 and 6.

A preferably integrally formed rocker arm 94 is located at the distal portion of link 88. The rocker arm 94 extends partially out of the housing 64 through an opening 96 which is located at the bottom of the side plate 72 and thereby acts as a guide for the drop target 26 as it moves between its up and down positions, as shown in FIGS. 5 and 6.

A switch 98 is attached to the outside surface of the side plate 72 with contacts 100 positioned in the path of the rocker arm 94. The switch 98 is used to signal when the drop target 26 drops to the down position and thereby register a score on the pinball machine. When the drop target 26 is in the up position, the rocker arm 94 does not contact the contacts 100 and the switch 98 is open circuited. When the drop target 26 drops to the down position, the distal portion of the rocker arm 94 comes in contact and thereby closes the switch 98.

In pinball machines it is important that the playfield be designed so that a ball will not stick in any of the play features during its play. To this end, a stop bracket 102 is provided which acts as a stop for the drop target 26 when in the down position. The stop bracket 102 is adjustably mounted to the bottom of the side plate 72 by a tab 104 with a plate 106 extending parallel to and below a flat bottom surface 107 of the support 78. The position of the plate 106 can be adjusted to vary the height of the drop target 26 in the down position to insure that the top surface of the drop target 26 is precisely flush with the top surface of the playfield 14 and thereby prevent the formation of a slight recess that could retain the ball during play. This is done to compensate for the varying thickness of the playfield 14. As a further preventive step the top surface of the drop target 26 can be cambered out.

Further to insure that a ball will not be stuck in an opening between the top surface of the drop target 26 and the slot 34 when the drop target 26 is in the down position, a lip 108 is located on the top edge of the drop target 26. The lip 108 is perpendicular to the target face 50 and extends from the front and back surfaces of the target body 42. The lip 108 is of sufficient size to substantially block the slot 34 with the drop target 26 in the down position (see FIG. 3).

As noted before, the structures of the drop targets 28, 30 and 32 and their associated reset mechanisms are identical to the structure of the drop target 26 and its associated reset mechanism. Accordingly, although not visible in the figures, an adjustable stop bracket similar to the stop bracket 102 is provided for each of the drop targets 28, 30 and 32 to regulate the heights of the respective drop targets in the down position. Also, although not visible in the figures, a switch similar to the switch 98 is provided for each of the drop targets 28, 30 and 32 to signal when each of the respective drop targets has fallen to the down position.

In accordance with another important aspect of the present invention, resetting means 60 is provided for raising the drop targets to the up position after they all have fallen to the down position as a result of being struck by the ball or at the start of play of each ball. It should be understood from FIG. 2 that the drop targets 28, 30 and 32 are similar to the drop target 26 and are each respectively pivotally mounted to links 109, 110, and 112, which are each pivotally mounted to the shaft 90. As the drop targets 26, 28, 30 and 32 change from the up to down position, respectively, the links 88, 109, 110 and 112 each pivot about the shaft 90 in parallel planes.

To reset the drop targets from the down position to the up position, a reset bar 114 is provided which comprises a plate 116 which is located under and aligned with the bottom edges of the links 88, 109, 110 and 112. The plate 116 is attached at its ends perpendicularly to the bottom edges of brackets 118 and 120. The brackets 118 and 120 are generally parallel to links 88, 109, 110 and 112 and are similarly pivotally attached to the shaft 90. The plate 116 is attached to the brackets 118 and 120 so that as reset bar 114 is pivoted about the shaft 90, the plate 116 comes in contact with and pivots the links 88, 109, 110 and 112 about the shaft 90.

To drive or to move the plate 116 to raise the drop targets, a solenoid 122 is provided which is attached to the outer surface of the front plate 68. The solenoid 122 is located above a pin 124 which is attached perpendicularly to a distal portion of the outer face of the bracket 118 and extends out of the interior of the housing 64 through a slot 126 in the front plate 68. The slot 126 is shaped to allow the reset bar 114 to freely pivot about the shaft 90. A plunger 128 of the solenoid 122 is pivotally connected by a linkage 130 to the pin 124. The purpose of the solenoid 122 is to reset the drop targets. In the unenergized state, the plunger 128 hangs loosely from the solenoid 122, thereby the reset bar 114 is located a predetermined distance below the bottom edges of the links in the down position. See FIGS. 3 and 6. To reset the drop targets, the solenoid 122 is activated by control means not shown in the figures for a limited period of time thereby pulling the plunger 128 up toward the solenoid 122, and through the linkage 130 and the pin 124 pivot the reset bar 114 about the shaft 90. As the reset bar 114 pivots about the shaft 90, it contacts the link 88, 109, 110 and 112 and forces the drop targets 26, 28, 30 and 32 to the up position. For example, as the link 88 is pivoted about the shaft 90 by the reset bar 114, the drop target 26 is forced up through the slots 34 and 74 until the surface 80 of the target body 42 engages the lip 76. As the solenoid 122 deactivates, the reset bar 114 swings down to the predetermined position below the links.

In keeping with the present invention a play feature can be constructed comprising a plurality of drop targets located in-line within a confined lane, with a first group of the targets associated with first resetting means which are actuated by a first solenoid, and a second group of targets associated with second resetting means which are actuated by a second solenoid. In this way variations of the device of the present invention can be designed which enhance the play and therefore the desirability of a pinball machine which incorporates the device of the present invention.

From the foregoing, is should be appreciated that a novel play feature for a pinball machine has been described which is rugged in construction and reliable in operation. The unique construction of the device enables the entire assembly to be easily installed during fabrication of pinball machine and allows the independent operation of each of the drop targets while also allowing all of the drop targets to be reset in a single action. The total cost of the play feature is substantially reduced since a single solenoid is required for resetting the drop targets. The play feature contains means for releasably maintaining a drop target in the up position which prevents a ball which has been propelled up the lane and which strikes a drop target from continuing up the lane and striking another drop target. Finally, the play feature contains means for adjusting the height of the drop targets in the down position to prevent a ball from hanging up in the play feature.

It should be understood that although certain preferred embodiments of the present invention have been illustrated and described, various modifications, alternatives and equivalents thereof will become apparent to those skilled in the art and, accordingly, the scope of the present invention should be defined only by the appended claims and equivalents thereof.

Various features of the invention are set forth in the following claims.

What is claimed is:

1. A play feature for use in a pinball machine having a playfield and at least one confined lane with an entrance, the play feature comprising;

a plurality of drop targets aligned in-line along the confined lane, each of the drop targets extending through an opening in the playfield and being movable between an up and a down position, each of the drop targets comprise a target body attached to the top of a support, the target body of each of the drop targets when in the up position extending above the playfield and being situated across and blocking substantially the entire lane whereby a ball traversing said lane must contact a first drop target in an up position prior to contacting any other drop target in an up position which is located behind said first drop target, and when in the down position allowing a ball rolling in the lane to freely pass;

means for releasably maintaining each of the drop targets in the up position until struck by a ball propelled up the lane;

resetting means for simultaneously raising the drop targets from the down position to the up position;

driving means for driving the resetting means in response to an electric signal being applied thereto; and means for adjustably limiting the downward movement of each of the drop targets in the down position so that its top surface is in the same plane as a top surface of the playfield and thereby will not interfere with the roll of the ball.

2. The play feature of claim 1 wherein the top surface of each of the drop targets is substantially the same size as the associated openings in the playfield so that a space between each of the drop targets in the down position and the associated openings in the playfield will not interfere with the roll of the ball.

3. The play feature of claim 2 wherein the maintaining means insure that a ball which has been propelled into the lane and has struck the target body of one of the drop targets when in the up position will rebound off the drop target rather than continuing up the lane past the drop target.

4. The play feature of claim 3 wherein the maintaining means further comprises restraining means for restraining the horizontal motion of a drop target as it falls from the up position to the down position after being struck by a ball, thereby insuring that the ball will rebound off the drop target rather than continue up the lane past the drop target.

5. The play feature of claim 4 whereby the target body of each of the drop targets has a flat surface located on a front bottom edge, and wherein the maintaining means further comprises: a lip located along and partially block the front of its associated opening and having a top surface which mates with the flat surface of the target body of the associated drop targets; and a spring being connected to the drop target and angularly oriented to forward bias the drop target in a downward direction so that when the drop target is raised from the down position to the up position, the flat surface of the target body passes the top surface of the associated lip, and the target body is pulled forward by the spring thereby engaging the flat surface and the top surface and remains so engaged until hit by a ball propelled up the lane.

6. The play feature of claim 5 wherein the maintaining means further comprises a spring bracket located a predetermined distance below and in front of one of the drop targets, the spring being attached at one end to the support of the drop target and at the other end to the spring bracket.

7. The play feature of claim 2 or claim 6 wherein the maintaining means further comprising a shaft and a plurality of elongated links, each having one end portion pivotally attached to the shaft and the other end portion connected to one of the drop targets, whereby as each of the drop targets moves between the up and down positions the links pivot about the shaft.

8. The play feature of claim 7 wherein the resetting means comprises a reset bar having a plate located beneath and generally transverse to the orientation of the links, and means for pivotally connecting the plate to the shaft so that as the reset bar is pivoted about the shaft the plate comes in contact with and pivots the links about the shaft.

9. The play feature of claim 8 wherein the pivotally connecting means comprises two reset brackets each attached to an opposite end of the plate and being generally parallel to the links, and similarly pivotally attached to the shaft.

10. The play feature of claim 9 wherein the driving means comprises a solenoid drivingly coupled to the reset bar.

11. The play feature of claim 10 wherein when the electric signal is not applied to the solenoid the plate hangs a predetermined distance below the bottom edges of the links of the associated drop targets in the down position, and when the electric signal is applied the solenoid pivots the reset bar about the shaft a distance sufficient to contact the bottom edges of the links of the associated drop targets in the down position with the plate and raise the drop targets to the up position.

12. A play feature for use in a pinball machine having a playfield and at least one confined lane with an entrance, the play feature comprising;

a plurality of drop targets aligned in-line along the confined lane, each of the drop targets extending through an opening in the playfield and being movable between an up position and a down position;

means for releasably maintaining each of the drop targets in the up position until struck by a ball propelled up the playfield;

resetting means for simultaneously raising the drop targets from the down position to the up position; driving means for driving the resetting means in response to an electric signal being applied thereto;

each of said drop targets comprising a target body attached to the top of a support, the target body of each of said drop targets when in the up position extending above the playfield and being situated across and blocking substantially the entire lane whereby a ball traversing said lane must contact a first drop target in the up position prior to contacting any other drop target in the up position which is located behind said first drop target, and when in the down position allowing a ball to roll in the lane to freely pass.

13. The play feature of claim 12 further comprising means for adjustably limiting the downward movement of each of the drop targets in the down position so that its top surface is in the same plane as a top surface of the playfield and thereby will not interfere with the roll of the ball.

14. The play feature of claim 13 wherein the top surface of the drop targets is substantially the same size as the associated openings in the playfield so that a space between each of the drop targets in the down position and the associated openings in the playfield will not interfere with the roll of the ball.

15. The play feature of claim 14 wherein the maintaining means insure that a ball which has been propelled into the lane and has struck the target body of one of the drop targets when in the up position will rebound off the drop target rather than continuing up the lane past the drop target.

16. The play feature of claim 15 wherein the maintaining means further comprises restraining means for restraining the horizontal motion of a drop target as it falls from the up position to the down position after being struck by a ball, thereby insuring that the ball will rebound off the drop target rather than continue up the lane past the drop target.

17. The play feature of claim 16 whereby the target body of each of the drop targets has a flat surface located on a front bottom edge, and wherein the maintaining means further comprises: a lip located along and partially block the front of its associated opening and having a top surface which mates with the flat surface of the target body of the associated drop targets; and a spring being connected to the drop target and angularly oriented to forward bias the drop target in a downward direction so that when the drop target is raised from the down position to the up position, the flat surface of the target body passes the top surface of the associated lip, and the target body is pulled forward by the spring thereby engaging the flat surface and the top surface and remains so engaged until hit by a ball propelled up the lane.

18. The play feature of claim 17 wherein the maintaining means further comprises a spring bracket located a predetermined distance below and in front of one of the drop targets, the spring being attached at one end to the support of the drop target and at the other end to the spring bracket.

19. The play feature of claim 14 or claim 6 wherein the maintaining means further comprising a shaft and a plurality of elongated links, each having one end portion pivotally attached to the shaft and the other end portion connected to one of the drop targets, whereby as each of the drop targets moves between the up and down positions the links pivot about the shaft.

20. The play feature of claim 19 wherein the resetting means comprises a reset bar having a plate located beneath and generally transverse to the orientation of the links, and means for pivotally connecting the plate to the shaft so that as the reset bar is pivoted about the shaft the plate comes in contact with and pivots the links about the shaft.

21. The play feature of claim 20 wherein the pivotally connecting means comprises two reset brackets each attached to an opposite end of the plate and being generally parallel to the links, and similarly pivotally attached to the shaft.

22. The play feature of claim 21 wherein the driving means comprises a solenoid drivingly coupled to the reset bar.

23. The play feature of claim 22 wherein when the electric signal is not applied to the solenoid the plate hangs a predetermined distance below the bottom edges of the links of the associated drop targets in the down position, and when the electric signal is applied the solenoid pivots the reset bar about the shaft a distance sufficient to contact the bottom edges of the links of the associated drop targets in the down position with the plate and raise the drop targets to the up position.

* * * * *